US008038461B2

(12) United States Patent
Hsu

(10) Patent No.: US 8,038,461 B2
(45) Date of Patent: Oct. 18, 2011

(54) NETWORK LINE PLUG ASSEMBLY

(76) Inventor: Ching-Jen Hsu, Dongguan (CN)

( * ) Notice: Subject to any disclaimer, the term of this patent is extended or adjusted under 35 U.S.C. 154(b) by 0 days.

(21) Appl. No.: 12/769,656

(22) Filed: Apr. 29, 2010

(65) Prior Publication Data

US 2011/0195613 A1 Aug. 11, 2011

(51) Int. Cl.
*H01R 4/50* (2006.01)
*H01R 13/625* (2006.01)

(52) U.S. Cl. ..... 439/344; 439/676; 439/941

(58) Field of Classification Search ..... 439/344, 439/676, 941
See application file for complete search history.

(56) References Cited

U.S. PATENT DOCUMENTS

| | | | | |
|---|---|---|---|---|
| 6,042,427 | A * | 3/2000 | Adriaenssens et al. | 439/676 |
| 6,283,768 | B1 * | 9/2001 | Van Naarden | 439/76.1 |
| 6,599,148 | B1 * | 7/2003 | Jensen et al. | 439/460 |
| 6,837,738 | B1 * | 1/2005 | Chen | 439/418 |
| 7,335,066 | B2 * | 2/2008 | Carroll et al. | 439/676 |

* cited by examiner

*Primary Examiner* — Hae Moon Hyeon
(74) *Attorney, Agent, or Firm* — Alexander Chen, Esq.

(57) ABSTRACT

A network line plug and network line, and more particularly to a network line plug, network line plug assembly and network line; the network line plug of the present invention comprises of a short-head main body, rubber core and eight welded terminals; the rubber core is fixed into the short-head main body; said welded terminals are inserted into the rubber core; the first and second ends of said welded terminal are an electrical contact portion and welding portion, respectively; the welding portions of the welded terminal penetrate selectively the through-holes of the rubber core; the welding portions of two welded terminals corresponding to the same core pair are arranged adjacent to one another.

9 Claims, 10 Drawing Sheets

NETWORK LINE PLUG ASSEMBLY

BACKGROUND OF INVENTION

1. Field of the Invention

The present invention relates generally to the technology field of a network line plug and network line, and more particularly to a network line plug, plug assembly and network line.

2. Description of Related Art

The currently available network line plug is of a puncture structure, which comprises a main body, laying rubber plug, threading rubber plug, internal metal casing and external metal casing; eight core wires of the network cable penetrate separately through-hole on the threading rubber plug, which allows to position and assign these core wires onto the connecting location; the front end of the core wire is inserted into the groove on the laying rubber plug, which is used to fix these eight core wires and arrange them in a line; the main body is provided with eight slots, wherein a contact chip is inserted; when the network line plug is installed, the contact chip is pressed into the main body by a fixture; the tip of the contact chip punctures separately the core wire insulator to realize electrical connection with the core wire conductor. Generally, the trifid contact chip can puncture the core wire insulator of the cable to realize electrical connection between network plug and cable conductor. The network plug is processed technically as follows:

1. Strip down the sheath of cable to a proper length;

2. Thread four pairs of core wires distributedly into the branching rubber plug, straighten and trim the core wires, then thread into the corresponding holes of the laying rubber plug by the sequence of plugs; next thread the laying rubber plug into the network plug.

3. Press the metal contact chip on the network plug by robot, and then puncture the core wire insulator to realize electrical connection between network plug and cable conductor.

If wiring with existing technology, green-white/green and blue-white/blue twisted pairs in the network line are intersected; meanwhile, as both branching rubber plug and laying rubber plug are used, the stripping length of the cable ends is increased, bringing about bigger damage to original twisted structure and characteristic impedance of the cable, and affecting greatly the near-end crosstalk of network line; owing to mismatching of the characteristic impedance of the network plug and the cable, the echo loss of the network line becomes bigger, so the data transmission quality is reduced, leading to bigger probability of defective products.

SUMMARY OF INVENTION

The main objective of the present invention is to provide a network line plug that can avoid crossing of core wire to guarantee the characteristics of the network line to the greatest possible extent and improve the data transmission quality.

Another objective of the present invention is to provide a network line plug assembly that can avoid crossing of core wire to guarantee the characteristics of the network line to the greatest possible extent and improve the data transmission quality.

The third objective of the present invention is to provide a network line that can avoid crossing of core wire to guarantee the characteristics of the network line to the greatest possible extent and improve the data transmission quality.

The efficacy of the present invention is: the network line plug of the present invention comprises: a short-head main body, rubber core and eight welded terminals; the rubber core is fixed into the short-head main body; the welded terminals are inserted into the rubber core; the first and second ends of said welded terminal are an electrical contact portion and welding portion, respectively; the welding portions of the welded terminal penetrate selectively the through-holes of the rubber core; the electrical contact portions of the welded terminals are arranged in a line, while the welding portions of two welded terminals corresponding to the same core pair are arranged adjacent to one another. When the network line plug of the present invention is connected to the network line as per the network link protocol, no crossing of core wires in the network line occurs, thus avoiding signal interference of core wires and improving efficiently the signal transmission capability of network line. Additionally, the core wires are directly welded onto the welding portion of the welded terminal, so the core wires are not required to pass through the threading rubber plug and laying rubber plug etc; in such case, the stripping length of the network line becomes very short; this causes little damage to original twisted structure of the network line, and guarantees the characteristic impedance and near-end crosstalk quality of the network line to the greatest possible extent, such that the characteristic impedance of the network line plug is matched with that of the core wire, thus reducing the echo loss and improving the data transmission capability of the network line with lower defects.

The second efficacy of the present invention is: the network line plug assembly of the present invention comprises of two network line plugs connected separately with the first and second ends of the network line; of which the network line plug connected with the first end of the network line is a primary plug, and that connected with the second end of the network line is a secondary plug; the welding portions of two welded terminals in the primary plug for connection with the core pairs of the network line (which are intersected when wiring as per the network link protocol) are arranged vertically in alignment with the welding portions of two welded terminals in the secondary plug; so the network line plug assembly of the present invention can avoid crossing of core wires, guarantee the characteristics of the network line to the great possible extent and improve the data transmission quality.

The third efficacy of the present invention is: the network line of the present invention comprises of a network cable and network line plug assembly, of which the first end of the network cable is connected with the primary plug, and the second end connected with the secondary plug; so the network line of the present invention can avoid crossing of core wires, guarantee the characteristics of the network line to the great possible extent and improve the data transmission quality.

The present invention is implemented by the following technical packages:

A network line plug, comprising of a short-head main body, rubber core and eight welded terminals corresponding to eight core wires of the network line; eight slots are arranged in parallel at the lower surface of said short-head main body for insertion of the electrical contact within the female socket; the rubber core is fixed into the short-head main body; said welded terminal is inserted into the rubber core; the first end of said welded terminal is an electrical contact portion used for electrical connection between the welded terminal and the electrical contact within the female socket; the electrical contact portions are arranged in a row; the second end of said welded terminal is a welding portion used for welding separately eight core wires of the network line onto the corresponding welded terminals;

Said rubber core is provided with through-holes for the welding portion of the welded terminal; the through-holes penetrate the front and rear surfaces of the rubber core, while the welding portions of two welded terminals corresponding to the same core pair are arranged adjacent to one another.

Said through-holes are arranged longitudinally in two lines, and also transversely in four rows;

After penetrating the through-hole of the rubber core, the welding portions of said welded terminal are arranged at the rear end of the rubber core in such a manner that eight core wires of the network line can be arranged in parallel, and the twisted structure of the network line can be welded in pair onto the welding portions of the welded terminal; the welding portions of said welded terminal are arranged in two lines and four rows;

The welding portion of any welded terminal set on the rubber core can penetrate selectively the through-holes of the rubber core at upper or lower lines.

Said welded terminal is of "C"-shaped pattern, of which the electrical contact portion and welding portion are arranged in parallel, and the welding portion is provided with a folding portion at the center of welded terminal staggered horizontally in relation to the electrical contact portion.

Holding grooves are set on the lower surface of said rubber core correspondingly to the slots on said short-head main body; the electrical contact portion of said welded terminal is accommodated in the holding groove;

Front holding grooves are set on the front surface of said rubber core correspondingly to the holding grooves at lower surface of the rubber core, and used for insertion of the center of the welded terminal; the front holding grooves are connected with the corresponding holding grooves;

Said front holding grooves are connected with the corresponding through-holes.

The front holding grooves arranged from left to right at front surface of said rubber core comprise: first front holding groove, second front holding groove, third front holding groove, fourth front holding groove, fifth front holding groove, sixth front holding groove, seventh front holding groove and eighth front holding groove; the bottom of the first front holding groove is connected with the bottom of the second front holding groove; the center and bottom of the third front holding groove are separately connected with the center and bottom of the fourth front holding groove; the center and bottom of the fifth front holding groove are separately connected with the center and bottom of the sixth front holding groove; the bottom of the seventh front holding groove is connected with the bottom of the eighth front holding groove.

Said network line plug also comprises: internal and external metal casings; the front surface of said internal metal casing is sleeved externally onto the rubber core; the rear end of said internal metal casing is provided with a tail fin that enables users to fix the network line onto the internal metal casing by means of riveting; said internal metal casing is mounted securely into said short-head main body.

The front surface of said external metal casing is fixed onto said short-head main body, and said external metal casing is connected with the rear end of said short-head main body.

The electrical contact portion of said welded terminal is extended into the slot or otherwise externally onto the slot in parallel.

The upper surface of said short-head main body is provided with a resilient strip, both sides of which are separately profiled into hooks that can prevent disengagement of the network line plug from the female socket.

A network line plug assembly, comprising of two network line plugs connected separately with the first and second ends of the network line; of which the network line plug connected with the first end of the network line is a primary plug, and that connected with the second end of the network line is a secondary plug.

The welding portions of two welded terminals in the primary plug for connection with the core pairs of the network line (which are intersected when wiring as per the network link protocol) are arranged vertically in alignment with the welding portions of two welded terminals in the secondary plug.

The welding portions of welded terminals in the primary plug for connection with the core pairs of the network line (which are intersected when wiring as per the network link protocol) penetrate the through-holes at the upper line; the welding portions of welded terminals in the secondary plug for connection with the core pairs of the network line (which are intersected when wiring as per the network link protocol) penetrate the through-holes at the lower line in the same row.

A network line, comprising of a network cable and network line plug assembly; the first end of the network cable is connected with the primary plug, and the second end connected with the secondary plug.

According to the electrical contact portion, eight welded terminals arranged from left to right on said primary plug comprise: first terminal, second terminal, third terminal, fourth terminal, fifth terminal, sixth terminal, seventh terminal and eighth terminal; of which, the welding portions of the second, fourth, fifth and seventh terminals of the primary plug penetrate from left to right the through-holes at the upper line, whilst the welding portions of the first, third, sixth and eighth terminals of the primary plug penetrate from left to right the through-holes at the lower line;

The first, second, third, fourth, fifth, sixth, seventh and eighth terminals of said primary plug are connected with the orange white, orange, green white, blue, blue white, green, brown white and brown core wires, respectively, at the first end of the network cable;

According to the electrical contact portion, eight welded terminals arranged from left to right on said secondary plug comprise: first terminal, second terminal, third terminal, fourth terminal, fifth terminal, sixth terminal, seventh terminal and eighth terminal; of which, the welding portions of the second, third, sixth and seventh terminals of the secondary plug penetrate from left to right the through-holes at upper line, whilst the welding portions of the first, fourth, fifth and eighth terminals of the secondary plug penetrate from left to right the through-holes at lower line;

The first, second, third, fourth, fifth, sixth, seventh and eighth terminals of said secondary plug are connected with the orange white, orange, green white, blue, blue white, green, brown white and brown core wires, respectively, at the second end of the network cable.

DETAILED DESCRIPTION OF THE INVENTION

Preferred Embodiment 1

Figure 1:
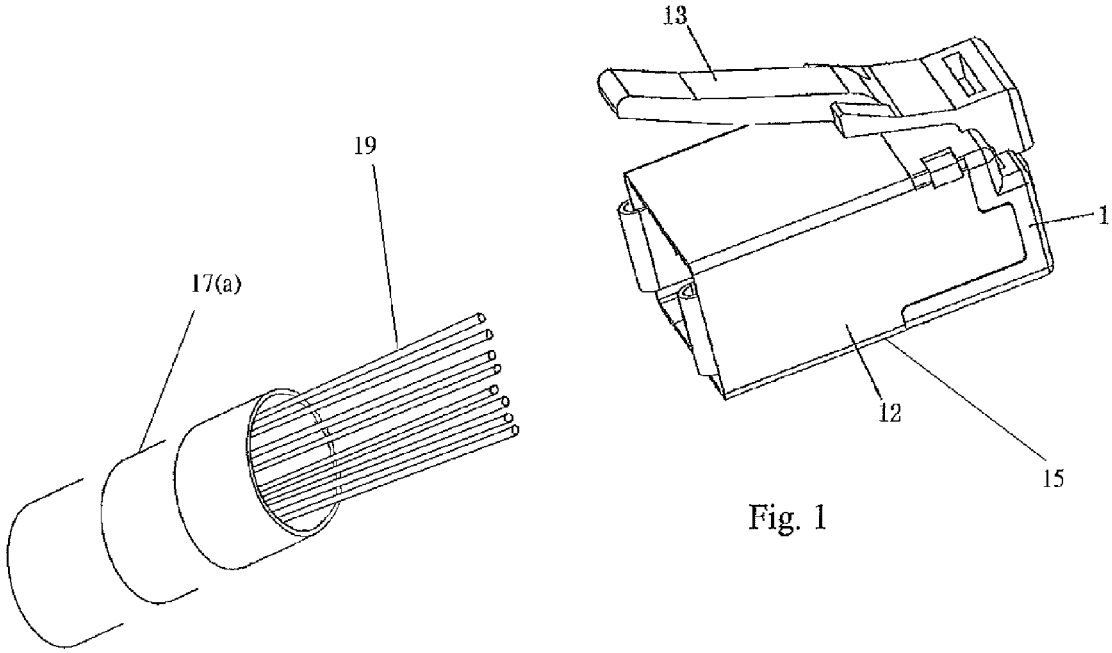
FIG. 1: a structural view of the first preferred embodiment of the network line plug of the present invention.
Figure 2:
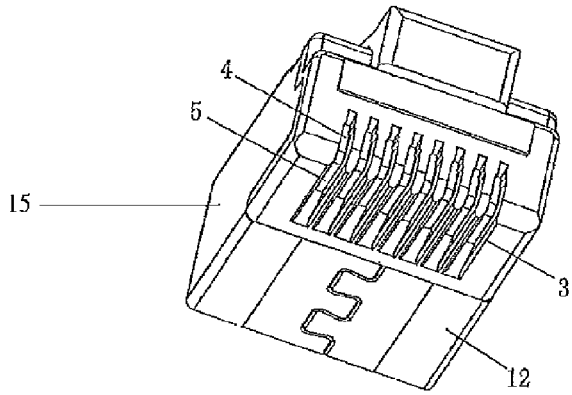
FIG. 2: a structural view from another viewing angle in the first preferred embodiment of the network line plug of the present invention.
Figure 3:
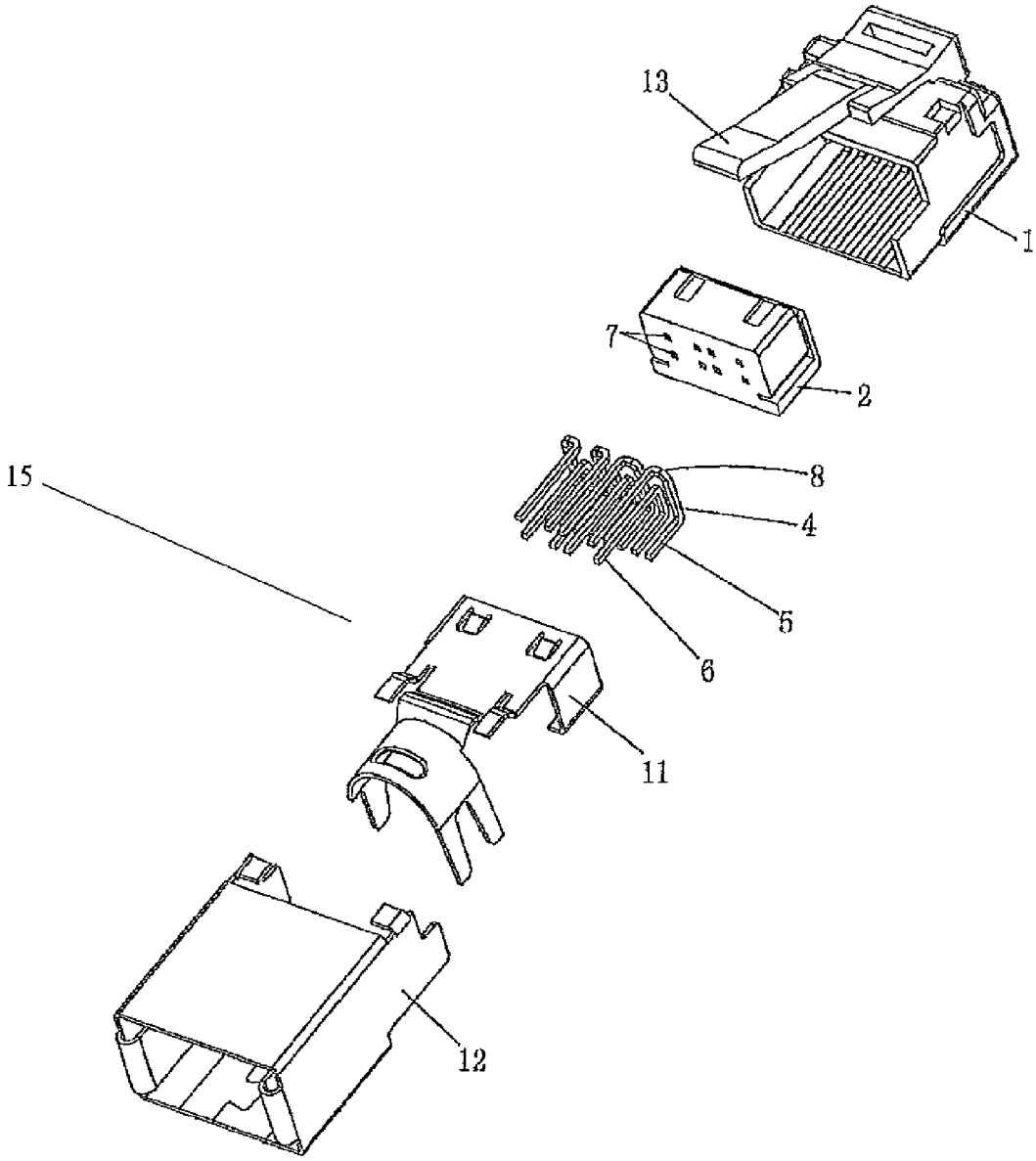
FIG. 3: an exploded view of the first preferred embodiment of the network line plug of the present invention.
Figure 4:
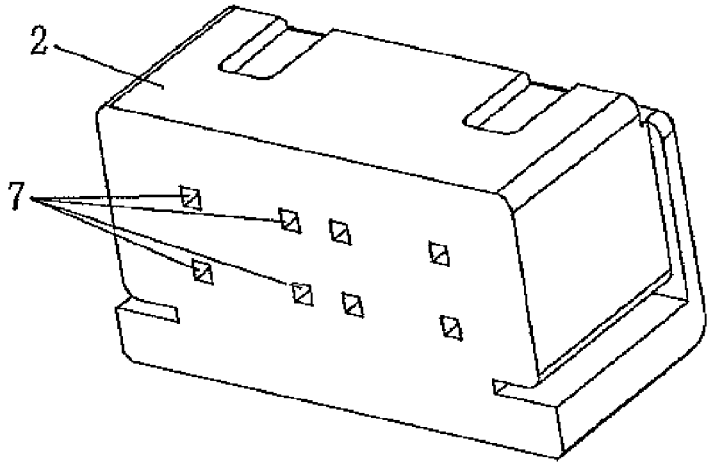
FIG. 4: a structural view of the rubber core in the first preferred embodiment of the network line plug of the present invention.
Figure 5:
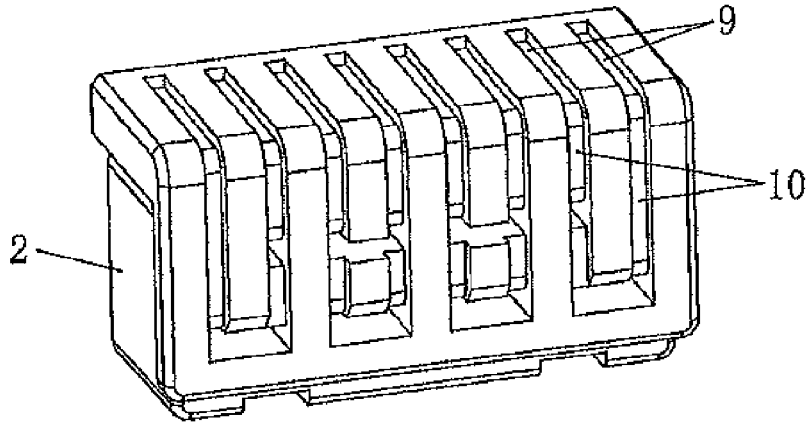
FIG. 5: a structural view from another viewing angle in the rubber core in the first preferred embodiment of the network line plug of the present invention.
Figure 6:
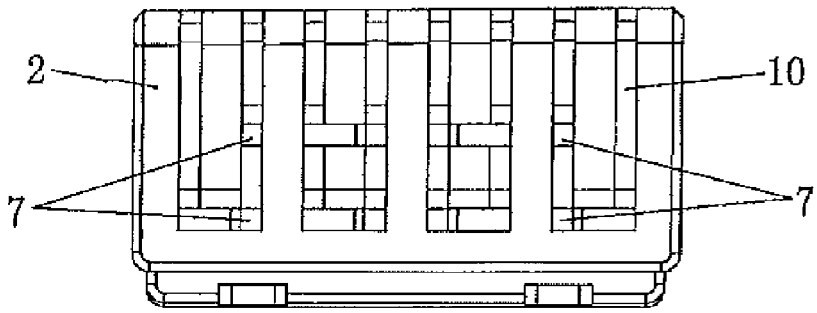
FIG. 6: a main view of FIG. 5.
Figure 7:
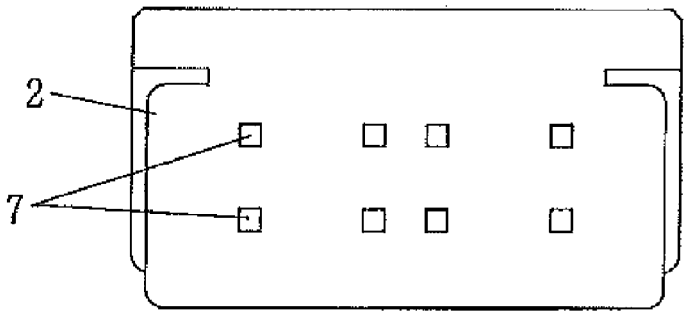
FIG. 7: a rear view of FIG. 5.
Figure 8:
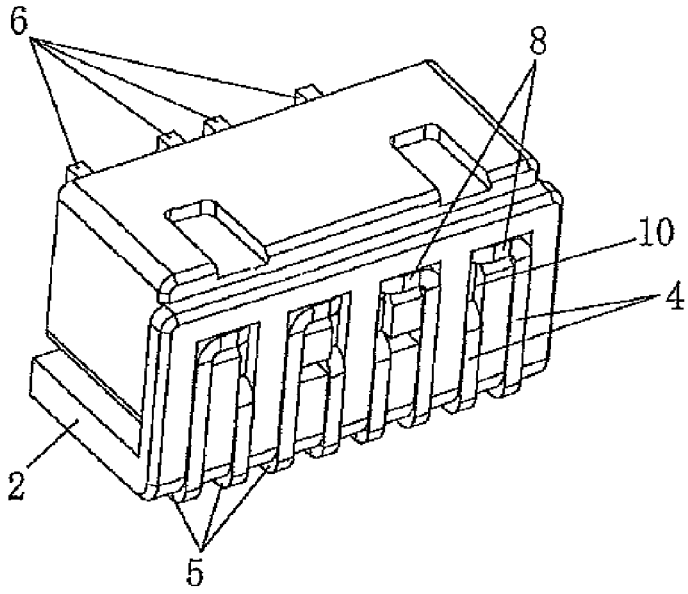
FIG. 8: a structural view of the first preferred embodiment of the network line plug of the present invention that the rubber core is provided with welded terminals.
Figure 9:
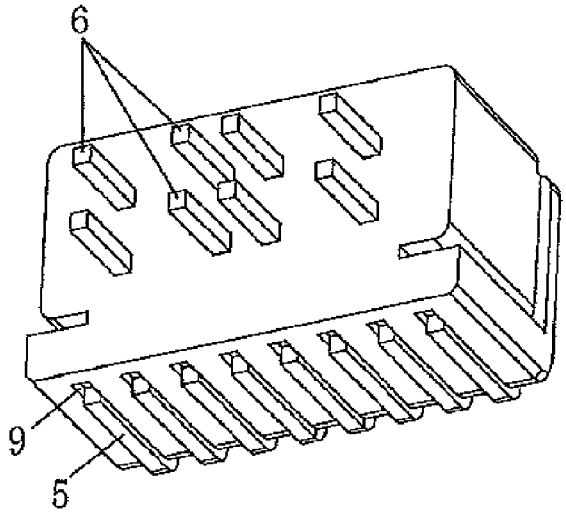
FIG. 9: a structural view from another viewing angle in the first preferred embodiment of the network line plug of the present invention that the rubber core is provided with welded terminals.
Figure 10:
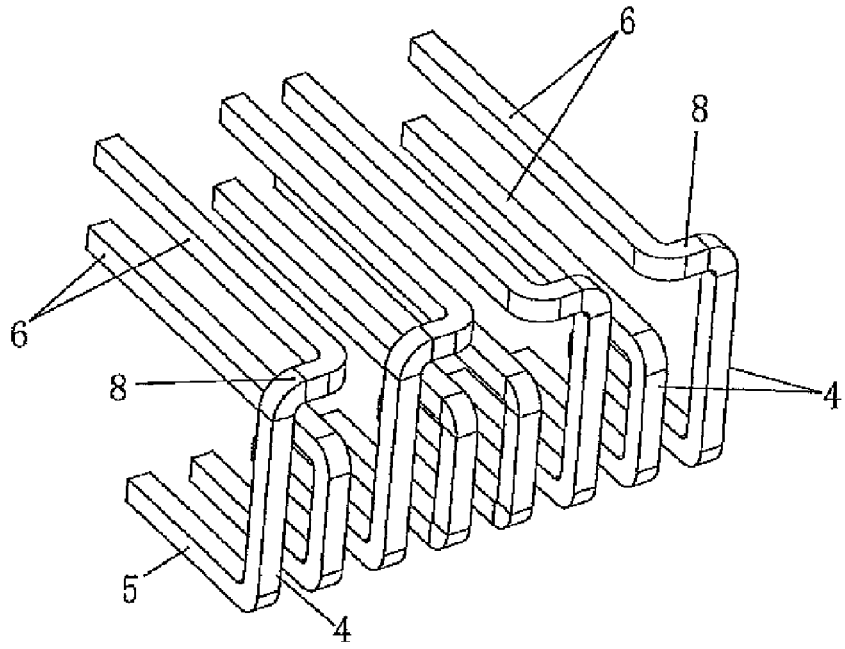
FIG. 10: a structural view of the welded terminal in the first preferred embodiment of the network line plug of the present invention.
Figure 11:
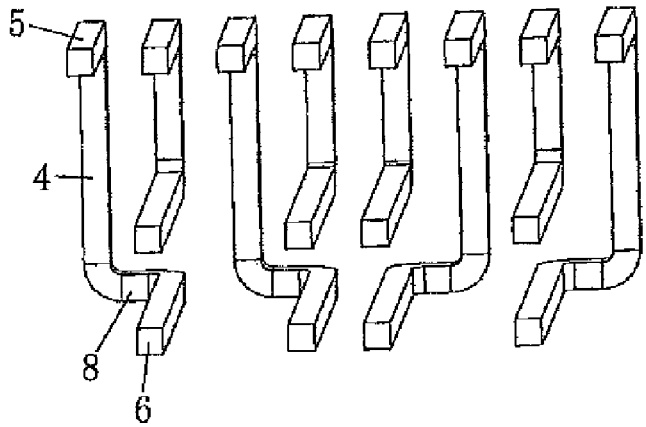
FIG. 11: a structural view of the welded terminal from another viewing angle in the first preferred embodiment of the network line plug of the present invention.

The first preferred embodiment of the network line plug of the present invention is shown in FIGS. 1~11, wherein it comprises a short-head main body 1 and a rubber core 2; eight slots 3 are arranged in parallel onto the lower surface of said short-head main body 1, and used for insertion of the electrical contact within the female socket; said rubber core 2 is fixed into the short-head main body 1.

The present invention also comprises eight welded terminals 4, which are aligned separately with eight core wires 19 of a network cable 17; said welded terminals 4 are inserted into the rubber core 2; the first ends of the welded terminals 4 are electrical contact portions 5, which are arranged in a line and used for electrical connection between the welded terminals 4 and electrical contacts within the female socket; the second ends of the welded terminals 4 are welding portions 6, which are used to weld separately eight core wires 19 of the network line onto the corresponding welded terminals 4. Said welded terminal 4 is prefabricated into a simple structure, making it easier for processing and production with lower cost.

Said rubber core 2 is provided with through-holes 7 for the welding portion 6 of the welded terminal 4; the through-holes 7 penetrate the front and rear surfaces of the rubber core 2, while the welding portions 6 of two welded terminals 4 corresponding to the same core pair are arranged adjacent to one another. As the twisted core wires 19 of the network cable 17 can be welded onto the adjacent welding portions 6, no crossing phenomenon of core wires 19 occurs when the welding portions 6 are connected, thus addressing the crossing problem of core wires 19.

Specifically, said through-holes 7 are arranged longitudinally in two lines, and also transversely in four rows; after penetrating the through-holes 7 of the rubber core 2, the welding portions 6 of said welded terminal 4 are arranged at the rear end of the rubber core 2 in such a manner that eight core wires 19 of the network cable 17 can be arranged in parallel, and the twisted structure of the network line can be welded in pair onto the welding portions 6 of the welded terminal 4; the welding portions 6 of said welded terminal 4 are arranged in two lines and four rows.

The welding portion 6 of any welded terminal 4 set on the rubber core 2 can penetrate selectively the through-holes 7 of the rubber core at upper or lower lines. If necessary, the corresponding welded terminal 4 can be selected; the welding portion 6 of the welded terminal 4 can penetrate selectively the through-holes 7 of the rubber core 2 at upper or lower line.

More specifically, said welded terminal 4 is of "C"-shaped pattern, of which the electrical contact portion 5 and welding portion 6 are arranged in parallel, and the welding portion 6 is provided with a folding portion 8 at the center of welded terminal 4 staggered horizontally in relation to the electrical contact portion 5. As the electrical contact portions 5 of the welded terminals 4 are located at the same level, the welded terminals 4 with different spacing of the welding portion 6 and electrical contact portion 5 are generated, so the welding portion 6 of the welded terminal 4 can penetrate selectively the through-holes 7 of the rubber core at upper or lower lines. A folding portion 8 is arranged at the center of the welded terminal 4; the welding portion 6 of the welded terminal 4 can penetrate selectively the corresponding through-hole 7.

Furthermore, holding grooves 9 are set on the lower surface of said rubber core 2 correspondingly to the slots 3 on said short-head main body 1; the electrical contact portion 5 of said welded terminal 4 is accommodated in the holding groove 9; front holding grooves 10 are set on the front surface of said rubber core 2 correspondingly to the holding grooves 9 at lower surface of the rubber core 2, and used for insertion of the center of the welded terminal 4; the front holding grooves 10 are connected with the corresponding holding grooves 9 and through-holes 7.

The front holding grooves 10 arranged from left to right at front surface of said rubber core 2 comprise: first, second, third, fourth, fifth, sixth, seventh and eighth front holding grooves; the bottom of the first front holding groove is connected with the bottom of the second front holding groove; the center and bottom of the third front holding groove are separately connected with the center and bottom of the fourth front holding groove; the center and bottom of the fifth front holding groove are separately connected with the center and bottom of the sixth front holding groove; the bottom of the seventh front holding groove is connected with the bottom of the eighth front holding groove.

Said rubber core 2 is designed specifically such that the rubber core 2 can be adapted to different shapes of welded terminals 4, all of which can be mounted onto the rubber core 2; and the welding portion 6 of the welded terminal 4 can be inserted into the corresponding through-hole 7, and the rubber core 2 can be used to the network line plug with different definitions.

Furthermore, said network line plug also comprises internal metal casing 11 and external metal casing 12, of which the front surface of said internal metal casing 11 is sleeved externally onto the rubber core 2; the rear end of said internal metal casing 11 is provided with a tail fin that enables users to fix the network line onto the internal metal casing 11 by means of riveting; said internal metal casing 11 is mounted securely into said short-head main body 1.

The front surface of said external metal casing 12 is fixed onto said short-head main body 1, and said external metal casing 12 is connected with the rear end of said short-head main body 1.

The electrical contact portion 5 of said welded terminal 4 is extended into the slot 3 or otherwise externally onto the slot 3 in parallel.

The upper surface of said short-head main body 1 is provided with a resilient strip 13, both sides of which are separately profiled into hooks that can prevent disengagement of the network line plug from the female socket.

When the network line plug of the present invention is connected to the network cable 17 as per the network link protocol, no crossing of core wires 19 in the network cable 17 occurs, thus avoiding signal interference of core wires and improving efficiently the signal transmission capability of network line. Additionally, the core wires 19 are directly welded onto the welding portion of the welded terminal, so the core wires 19 are not required to pass through the threading rubber plug and laying rubber plug, etc; in such case, the stripping length of the network line becomes very short; this causes little damage to original twisted structure of the network line, and guarantees the characteristic impedance and near-end crosstalk quality of the network line to the greatest possible extent, such that the characteristic impedance of the network line plug is matched with that of the core wire, thus reducing the echo loss and improving the data transmission capability of the network line with lower defects.

Preferred Embodiment 2

Figure 12:
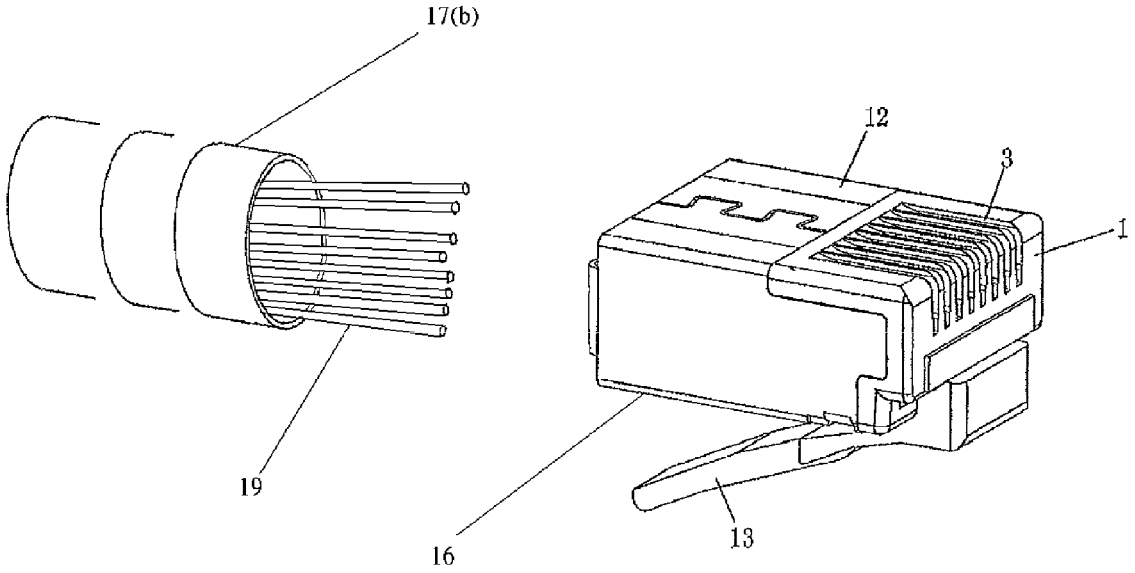
FIG. 12: a structural view of the second preferred embodiment of the network line plug of the present invention.
Figure 13:
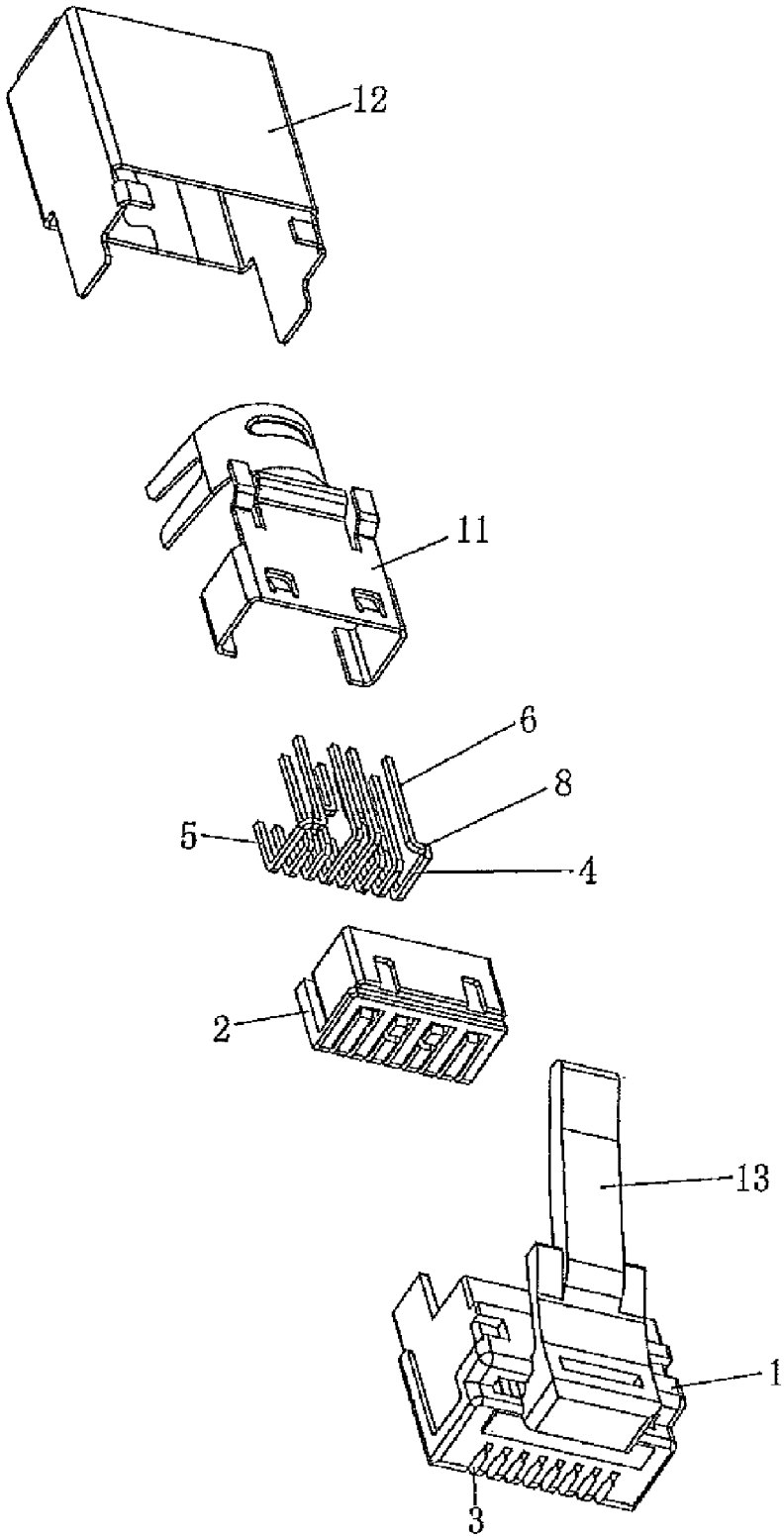
FIG. 13: an exploded view of the second preferred embodiment of the network line plug of the present invention.
Figure 14:
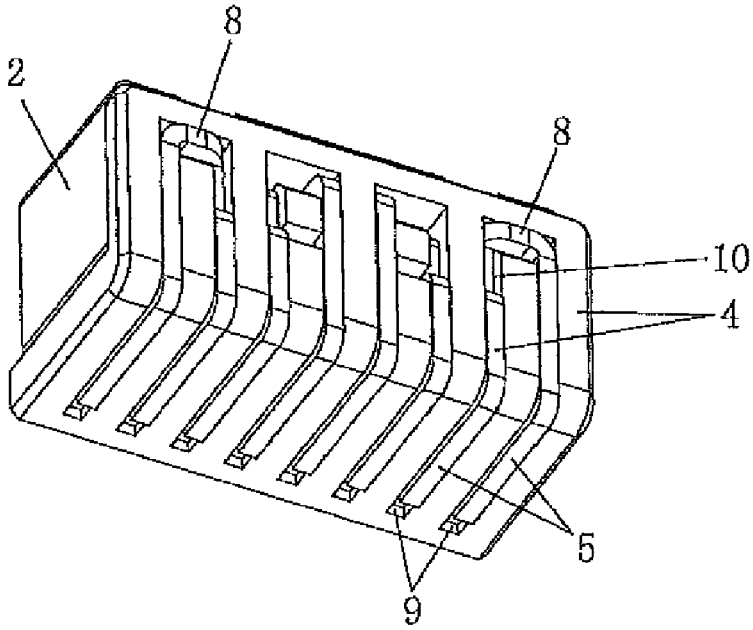
FIG. 14: a structural view of the second preferred embodiment of the network line plug of the present invention that the rubber core is provided with welded terminals.
Figure 15:
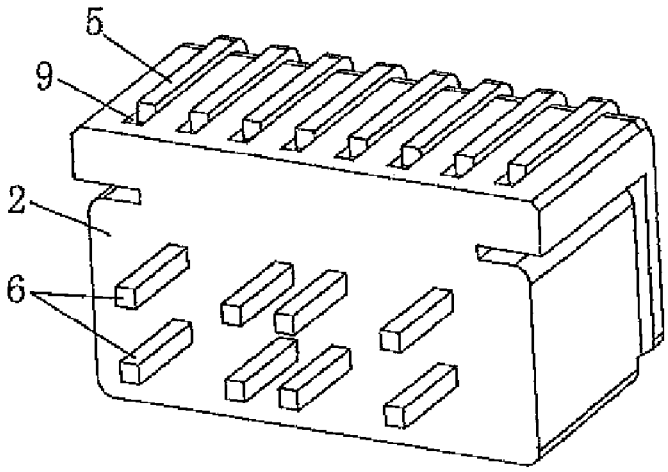
FIG. 15: a structural view from another viewing angle in the second preferred embodiment of the network line plug of the present invention that the rubber core is provided with welded terminals.
Figure 16:
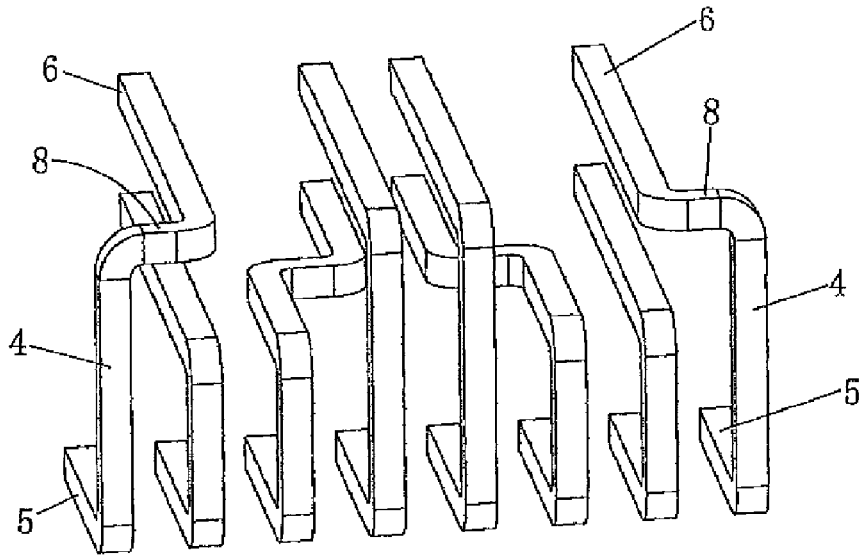
FIG. 16: a structural view of the welded terminal in the second preferred embodiment of the network line plug of the present invention.
Figure 17:
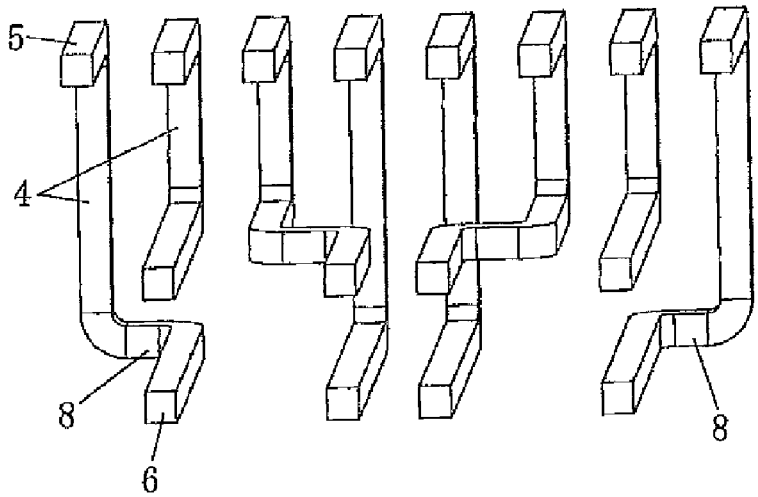
FIG. 17: a structural view of the welded terminal from another viewing angle in the second preferred embodiment of the network line plug of the present invention.

The second preferred embodiment of the network line plug of the present invention is shown in FIGS. 12~17, wherein the network line plugs of this preferred embodiment and previous one are used in pair, with the same structure and technical package; the difference with the first preferred embodiment lies in that: the welding portions 6 of said welded terminals 4 are arranged in a different way; in this preferred embodiment, the welding portions 6 of welded terminals 4 for connection with any pair pf core wires 19 of the network cable 17 (which are intersected when wiring as per the network link protocol) are arranged vertically in alignment with the welding portions 6 of welded terminals 4 in the first preferred embodiment.

Preferred Embodiment 3

The network line plug assembly of the present invention is implemented as shown in FIGS. 1~17.

The network line plug assembly comprises of a network line plug implemented in the first preferred embodiment and a network line plug in the second preferred embodiment; two network line plugs are separately connected with the first and second ends of the network cable 17, of which the network line plug connected with the first end of the network cable 17(*a*) is a primary plug 15, and that connected with the second end of the network cable 17(*b*) is a secondary plug 16.

The welding portions 6 of two welded terminals 4 in the primary plug 15 for connection with any pair of core wires 19 of the network cable 17 (which are intersected when wiring as per the network link protocol) are arranged vertically in alignment with the welding portions 6 of two welded terminals 4 in the secondary plug.

The welding portions 6 of welded terminals 4 in the primary plug 15 for connection with any pair of core wires 19 of the network cable 17 (which are intersected when wiring as per the network link protocol) penetrate the through-holes 7 of the rubber core 2 at the upper line; the welding portions 6 of welded terminals 4 in the secondary plug 16 for connection with the core pairs of the network line (which are intersected when wiring as per the network link protocol) penetrate the through-holes 7 of the rubber core 2 at the lower line in the same row.

When the network line plug assembly of the present invention is connected to the network line as per the network link protocol, no crossing of core wires in the network line occurs, thus avoiding signal interference of core wires and improving efficiently the signal transmission capability of network line. Additionally, the core wires are directly welded onto the welding portion of the welded terminal, so the core wires are not required to pass through the threading rubber plug and laying rubber plug, etc; in such case, the stripping length of the network line becomes very short; this causes little damage to original twisted structure of the network line, and guarantees the characteristic impedance and near-end crosstalk quality of the network line to the greatest possible extent, such that the characteristic impedance of the network line plug is matched with that of the core wire, thus reducing the echo loss and improving the data transmission capability of the network line with lower defects.

Preferred Embodiment 4

The network line of the present invention is implemented as shown in FIGS. 1~17.

The network line plug assembly further comprises of a network cable 17 and network line plug assembly implemented in the third preferred embodiment; the first end of the network cable 17(*a*) is connected with the primary plug 15, and the second end of the network cable 17(*b*) connected with the secondary plug 16.

According to the electrical contact portion 5, eight welded terminals 4 arranged from left to right on said primary plug 15 comprise: first, second, third, fourth, fifth, sixth, seventh and eighth terminals; of which, the welding portions 6 of the second, fourth, fifth and seventh terminals of the primary plug 15 penetrate from left to right the through-holes 7 at the upper line, whilst the welding portions 6 of the first, third, sixth and eighth terminals of the primary plug 15 penetrate from left to right the through-holes 7 at the lower line.

The first, second, third, fourth, fifth, sixth, seventh and eighth terminals of said primary plug 15 are connected with the orange white, orange, green white, blue, blue white, green, brown white and brown core wires 19, respectively, at the first end of the network cable 17(*a*).

According to the electrical contact portion 5, eight welded terminals 4 arranged from left to right on said secondary plug 16 comprise: first, second, third, fourth, fifth, sixth, seventh and eighth terminals; of which, the welding portions 6 of the second, third, sixth and seventh terminals of the secondary plug 16 penetrate from left to right the through-holes 7 at upper line, whilst the welding portions 6 of the first, fourth, fifth and eighth terminals of the secondary plug 16 penetrate from left to right the through-holes 7 at lower line.

The first, second, third, fourth, fifth, sixth, seventh and eighth terminals of said secondary plug 16 are connected with the orange white, orange, green white, blue, blue white, green, brown white and brown core wires 19, respectively, at the second end of the network cable 17(*b*).

No crossing of core wires in the network line of the present invention occurs, thus avoiding signal interference of core wires and improving efficiently the signal transmission capability of network line. Additionally, the core wires are directly welded onto the welding portion of the welded terminal, so the core wires are not required to pass through the threading rubber plug and laying rubber plug, etc; in such case, the stripping length of the network line becomes very short; this causes little damage to original twisted structure of the network line, and guarantees the characteristic impedance and near-end crosstalk quality of the network line to the greatest possible extent, such that the characteristic impedance of the network line plug is matched with that of the core wire, thus reducing the echo loss and improving the data transmission capability of the network line with lower defects.

The network line of the present invention is prefabricated into a simple structure, making it easier for processing and production with lower cost.

Although the invention has been explained in relation to its preferred embodiment, it is to be understood that many other possible modifications and variations can be made without departing from the spirit and scope of the invention as hereinafter claimed.

The invention claimed is:

1. A network line plug assembly, comprising a short-head main body and a rubber core; eight slots are arranged in parallel at the lower surface of said short-head main body; eight slots are arranged in parallel at the lower surface of said short-head main body for insertion of the electrical contact within a female socket; the rubber core is fixed into the short-head main body; it is characterized by that: eight welded terminals are aligned separately with eight core wires of a network cable; said welded terminals are inserted into the rubber core; the first ends of the welded terminals are electrical contact portions, which are arranged in a line and used for electrical connection between the welded terminals and electrical contacts within the female socket; the second ends of the welded terminals are welding portions, which are used to weld separately eight core wires of the network cable onto the corresponding welding portions of the welded terminals;

said rubber core is provided with through-holes for the welding portion of the welded terminal; the through-holes penetrate the front and rear surfaces of the rubber core, while the welding portions of two welded terminals corresponding to the same core pair are arranged adjacent to one another.

2. The network line plug assembly as claimed in claim 1, wherein said through-holes are arranged longitudinally in two lines, and also transversely in four rows;

after penetrating the through-hole of the rubber core, the welding portions of said welded terminal are arranged at the rear end of the rubber core in such a manner that eight core wires of the network cable can be arranged in parallel, and the twisted structure of the network cable can be welded in pair onto the welding portions of the welded terminal; the welding portions of said welded terminal are arranged in two lines and four rows;

the welding portion of any welded terminal set on the rubber core can penetrate selectively the through-holes of the rubber core at upper or lower lines.

3. The network line plug assembly as claimed in claim 2, wherein said welded terminal is of "C"-shaped pattern, of which the electrical contact portion and welding portion are arranged in parallel, and the welding portion is provided with a folding portion at the center of welded terminal staggered horizontally in relation to the electrical contact portion.

4. The network line plug assembly as claimed in claim 3, wherein holding grooves are set on the lower surface of said rubber core correspondingly to the eight slots on said short-head main body; the electrical contact portion of said welded terminal is accommodated in the holding groove;

front holding grooves are set on the front surface of said rubber core correspondingly to the holding grooves at lower surface of the rubber core, and used for insertion of the center of the welded terminal; the front holding grooves are connected with the corresponding holding grooves;

said front holding grooves are connected with the corresponding through-holes.

5. The network line plug assembly as claimed in claim 4, wherein the front holding grooves arranged from left to right at front surface of said rubber core comprise: first, second, third, fourth, fifth, sixth, seventh and eighth front holding grooves; the bottom of the first front holding groove is connected with the bottom of the second front holding groove; the center and bottom of the third front holding groove are separately connected with the center and bottom of the fourth front holding groove; the center and bottom of the fifth front holding groove are separately connected with the center and bottom of the sixth front holding groove; the bottom of the seventh front holding groove is connected with the bottom of the eighth front holding groove.

6. The network line plug assembly as claimed in claim 5, wherein said network line plug further comprising an internal and an external metal casings; the front surface of said internal metal casing is sleeved externally onto the rubber core; the rear end of said internal metal casing is provided with a tail fin that enables users to fix the network cable onto the internal metal casing by means of riveting; said internal metal casing is mounted securely into said short-head main body;

the front surface of said external metal casing is fixed onto said short-head main body, and said external metal casing is connected with the rear end of said short-head main body;

the electrical contact portion of said welded terminal is extended into the slot or otherwise externally onto one of the eight slots in parallel;

the upper surface of said short-head main body is provided with a resilient strip, both sides of which are separately profiled into hooks that can prevent disengagement of the network line plug from the female socket.

7. The network line plug assembly as claimed in claim 1 wherein said two network line plugs connected separately with the first and second ends of the network cable; of which the network line plug connected with the first end of the network cable is a primary plug, and that connected with the second end of the network cable is a secondary plug;

the welding portions of two welded terminals in the primary plug for connection with any pair of core wires of the network cable are arranged vertically in alignment with the welding portions of two welded terminals in the secondary plug.

8. The network line plug assembly as claimed in claim 7, wherein the welding portions of welded terminals in the primary plug for connection with any pair of core wires of the network cable penetrate the through-holes at the upper line; the welding portions of welded terminals in the secondary plug for connection with any pair of core wires of the network cable penetrate the through-holes at the lower line in the same row.

9. The network line plug assembly as claimed in claim 8, wherein according to the electrical contact portion, eight welded terminals arranged from left to right on said primary plug comprise: first, second, third, fourth, fifth, sixth, seventh and eighth terminals; of which, the welding portions of the second, fourth, fifth and seventh terminals of the primary plug penetrate from left to right the through-holes at the upper line, whilst the welding portions of the first, third, sixth and eighth terminals of the primary plug penetrate from left to right the through-holes at the lower line;

the first, second, third, fourth, fifth, sixth, seventh and eighth terminals of said primary plug are connected with the orange white, orange, green white, blue, blue white, green, brown white and brown core wires, respectively, at the first end of the network cable;

according to the electrical contact portion, eight welded terminals arranged from left to right on said secondary plug comprise: first, second, third, fourth, fifth, sixth, seventh and eighth terminals; of which, the welding portions of the second, third, sixth and seventh terminals of the secondary plug penetrate from left to right the through-holes at upper line, whilst the welding portions of the first, fourth, fifth and eighth terminals of the secondary plug penetrate from left to right the through-holes at lower line;

the first, second, third, fourth, fifth, sixth, seventh and eighth terminals of said secondary plug are connected with the orange white, orange, green white, blue, blue white, green, brown white and brown core wires, respectively, at the second end of the network cable.

* * * * *